US005195580A

United States Patent [19]

Hoeffken

[11] Patent Number: 5,195,580

[45] Date of Patent: Mar. 23, 1993

[54] HEAT EXCHANGER SEAM AND METHOD OF MAKING SAME

[75] Inventor: Russell W. Hoeffken, Belleville, Ill.

[73] Assignee: Ehrhardt Tool and Machine Co., Inc., St. Louis, Mo.

[21] Appl. No.: 834,887

[22] Filed: Feb. 11, 1992

[51] Int. Cl.[5] ..... F28F 3/12

[52] U.S. Cl. ..... 165/170; 29/463; 29/509; 29/521; 29/890.039

[58] Field of Search ..... 165/170; 126/99 R, 110 R, 126/116 R; 29/463, 509, 521, 890.039

[56] References Cited

U.S. PATENT DOCUMENTS

| | | | |
|---|---|---|---|
| 479,618 | 7/1892 | Bettendorf | 29/463 X |
| 700,575 | 5/1902 | Thompson | 29/521 |
| 2,845,284 | 7/1958 | Kallstrom | 285/192 |
| 3,757,855 | 9/1973 | Kun et al. | 165/166 |
| 3,807,382 | 4/1974 | Kennedy | 126/116 R |
| 3,813,752 | 6/1974 | Bemrose et al. | 29/202 D |
| 3,893,509 | 7/1975 | Satchwell et al. | 165/166 |
| 4,119,144 | 10/1978 | Kun | 165/175 |
| 4,298,061 | 11/1981 | Hoeffken | 165/170 |
| 4,441,241 | 4/1984 | Hoeffken | 29/509 X |
| 4,982,785 | 1/1991 | Tomlinson | 165/170 |
| 5,060,722 | 10/1991 | Zdenek et al. | 165/170 |

*Primary Examiner*—Allen J. Flanigan
*Attorney, Agent, or Firm*—Rogers, Howell & Haferkamp

[57] ABSTRACT

A heat exchanger cell for a furnace is constructed of first and second cell divisions, each cell division having a general concave configuration and a rim extending around at least a portion of a circumference of the cell division. The first and second cell divisions are positioned adjacent each other and the rim of one cell division is folded over the rim of the other cell division and overlaps opposite sides of the rim of the other cell division forming a seam joining the first and second rims. A crease is formed in the seam joining the cell division rims and is spaced from a terminal edge of the seam. A plurality of indentations are formed in the seam traversing the crease and spaced from the terminal edge of the seam. The crease and plurality of indentations formed in the seam enable the seam to resist relative movement between the rims of the two cell divisions due to alternating heating and cooling of the cell divisions.

3 Claims, 1 Drawing Sheet

HEAT EXCHANGER SEAM AND METHOD OF MAKING SAME

BACKGROUND OF THE INVENTION (1) Field of the Invention

The present invention pertains to a heat exchanger cell for a furnace. In particular, the present invention pertains to a heat exchanger cell constructed of a pair of cell divisions joined by a seam extending around at least a portion of the circumference of the cell divisions, wherein the seam is formed with a crease extending along the seam and a plurality of indentations traversing the crease. The crease and indentations formed in the seam improve the ability of the seam to resist relative movement between the two heat exchanger cell divisions joined by the seam as the heat exchanger is repeatedly heated and cooled in the cyclic operations of a furnace employing the heat exchanger.

(2) Description of the Related Art

Heat exchanger cells of the type pertaining to the present invention are typically employed in numbers of two or more in forced air heating furnaces. In most cases, two or more of the heat exchanger cells are assembled side-by-side in the interior of a furnace. Air to be heated is blown between the heat exchanger cells and over their exterior surfaces by a blower. Each heat exchanger cell contains a burner that heats the exterior walls of the cell and, in turn, heats the air passed over the walls by the furnace blower.

A typical heat exchanger cell is constructed from a pair of cell division side walls. In many prior art heat exchanger cells, the cell divisions are joined along complementary rims of each division by the rim of one division being folded over and crimped around the rim of the other division.

In use, the heat exchanger cells are subjected to cyclic heating and cooling, resulting in the metal of the heat exchanger cell divisions alternately expanding and contracting in response to the alternating heating and cooling cycles of the furnace. The cyclic heating and cooling of the cells results in thermally induced stresses in the seams joining the cell divisions that can cause separation of the crimped folds of the seam.

SUMMARY OF THE INVENTION

The present invention provides an improved heat exchanger cell constructed with an improved seam joining cell divisions of the heat exchanger. The present invention also provides the method of forming the improved seam.

In the heat exchanger cell of the present invention, first and second cell divisions, each having a general concavity and a rim extending around at least a portion of a circumference of the cell divisions, are joined along their rims by the seam of the invention produced according to the method of the invention. In constructing the seam, the pair of cell divisions are positioned adjacent each other with the rims of each cell division being adjacent and coextensive with each other. One of the rims is folded and crimped over the other so that it overlaps opposite sides of the other rim, thereby forming a seam joining the rims of the two heat exchanger cell divisions. The seam is formed with a crease extending along its length. The crease divides the seam into a first seam section adjacent the heat exchanger cell divisions and a second seam section adjacent the terminal edge of the seam. A plurality of indentations in the form of V-shaped grooves are formed in the crease of the seam. The plurality of indentations are spatially arranged along the crease and each indentation groove is formed with one end terminating in the first section of the seam and the second end terminating in the second section of the seam. The combination of the crease formed along the length of the folded over rim seam and the plurality of spatially arranged indentations traversing the crease produce an improved seam joining the cell divisions of the heat exchanger that resists relative movement between the cell divisions during cyclic heating and cooling operations of the heat exchanger.

BRIEF DESCRIPTION OF THE DRAWINGS

Further objects and features of the present invention ar revealed in the following detailed description of the preferred embodiment of the invention and in the drawing figures wherein.

DESCRIPTION OF THE PREFERRED EMBODIMENT

Figures 1, 2, 3, 4, 5, 6, 7, 8, 9, 10:
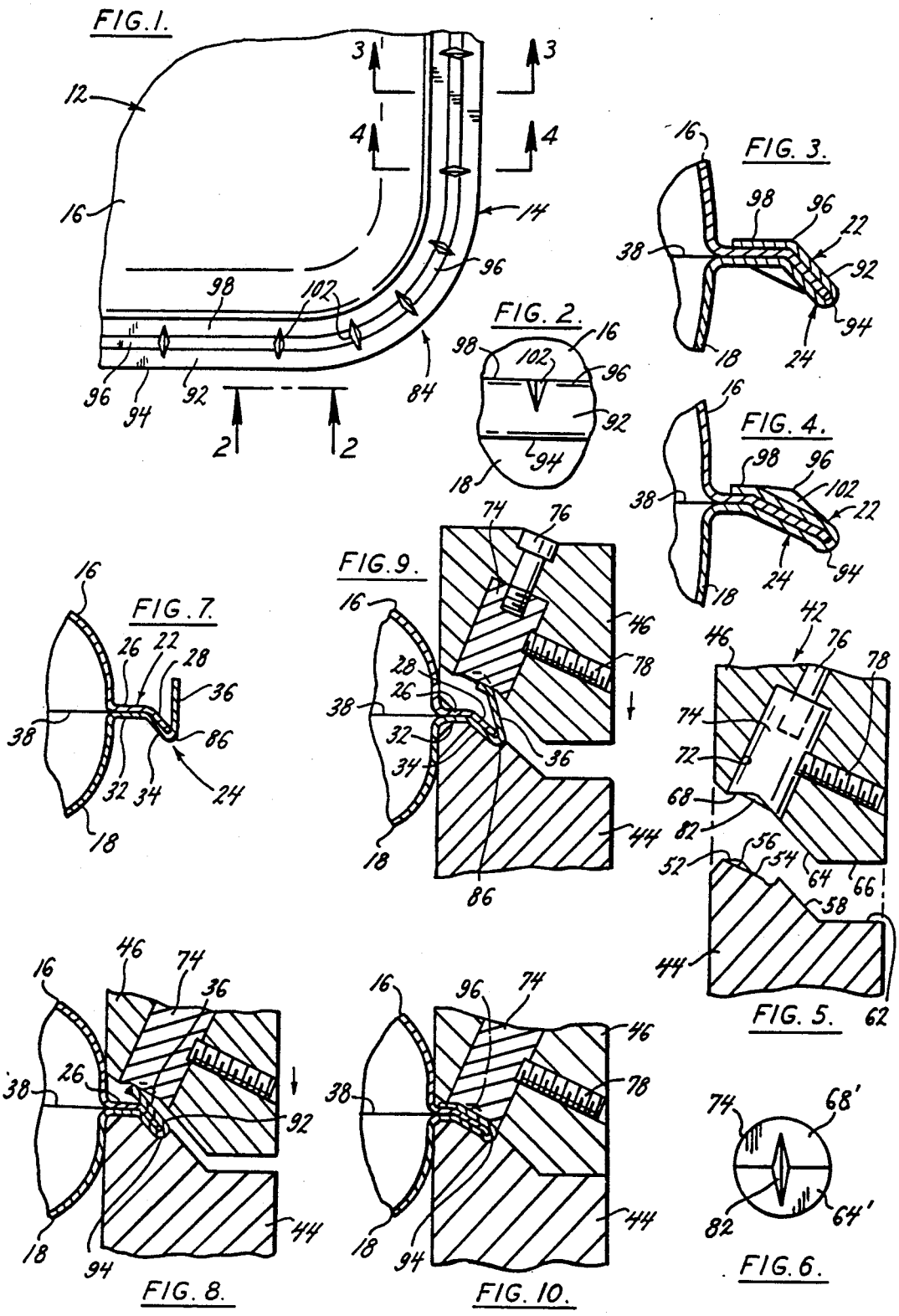
FIG. 1 is a partial elevation view of the corner of two heat exchanger cell divisions joined by the seam of the invention and according to the method of the invention.
FIG. 2 is a partial elevation view of the seam of the invention taken along the line 2—2 of FIG. 1.
FIG. 3 is a partial elevation view, in section, of the seam of the invention taken along the line 3—3 of FIG. 1.
FIG. 4 is a partial elevation view, in section, of the seam of the invention taken along the line 4—4 of FIG. 1.
FIG. 5 is an elevation view, in section, showing a tool employed in forming the seam of the invention according to the method of the invention.
FIG. 6 is an end view of the face of the tool employed in forming the seam of the invention.
FIG. 7 is an elevation view, in section, illustrating an initial step in forming the seam of the invention according to the method of the invention.
FIG. 8 is an elevation view, in section, illustrating a step of the method of the invention of forming the seam of the invention.
FIG. 9 is an elevation view, in section, illustrating a step of the method of the invention of forming the seam of the invention.
FIG. 10 is an elevation view, in section, illustrating a step of the method of the invention of forming the seam of the invention.

FIG. 1 shows a portion of a corner of a heat exchanger cell 12 employing the seam 14 of the present invention. In general, the heat exchanger cell 12 is constructed from two cell divisions 16, 18 each having a general concave configuration and each having a rim 22, 24 extending around at least a portion of the circumference of each cell division. The configurations of the two cell divisions 14, 16 and of their respective rims 22, 24 are complementary to each other. A cross section of the configurations of the two cell divisions 16, 18 and their respective rims 22, 24 before the rims are formed into the seam of the present invention in accordance with the method of the present invention is best seen in FIG. 7. The particular shape of the cell divisions 16, 18 shown in the drawing figures is illustrative of only one configuration of heat exchanger cell with which the seam of the invention may be employed and is not intended to be limiting. It should be understood that the seam and the method of forming the seam of the present invention may be employed in a variety of differently shaped heat exchanger cells other than that shown.

As seen in FIG. 7, the rim 22 of the upper cell division 16 is formed in two sections. A first section 26 of the rim is formed integrally with the cell division 16 and extends longitudinally from the peripheral edge of the cell division. The second rim section 28 is formed integrally with the first rim section 26 and extends at an angle relative to the first rim section 26 to the terminal edge of the rim 22.

The rim 24 of the lower cell division 18 as viewed in FIG. 7 is formed with three sections. The first section 32 of the lower cell division rim 24 is formed integrally with the cell division 18 and extends longitudinally from the peripheral edge of the cell division. The second rim section 34 is formed integrally with the first rim section 32 and extends at an angle relative thereto, the angle being substantially equal to the angle between the first and second rim sections 26, 28 of the upper rim 22. The third rim section 36 of the lower rim 24 is formed integrally with the second rim section 34 and extends at an angle of about 93° relative to the first rim section 32 as is shown in FIG. 7.

In assembling the two cell divisions 16, 18 together in forming a heat exchanger cell, the two cell divisions are placed in their respective positions shown in FIG. 7. The cell divisions 16, 18 are positioned adjacent each other with their concavities mutually opposed. The rim 22 of the upper cell division engages against the rim 24 of the lower cell division as shown in FIG. 7. Although only portions of the entire rims of the upper and lower cell divisions 16, 18 are shown in FIG. 7, it should be understood that the entire upper rim 22 of the upper cell division 16 engages against the entire lower rim 24 of the lower cell division 18 in the manner shown in FIG. 7. In this initial step of joining the two cell divisions by the seam of the present invention and according to the method of the present invention, it can be seen that the first sections 26, 32 of the upper and lower rims 22, 24 are positioned in a longitudinal plane 38 that is substantially the same plane that divides the upper and lower cell divisions 16, 18 in half. It can also be seen that the second sections 28, 34 of the upper and lower rims 22, 24 are oriented at substantially the same angle relative to the longitudinal plane 38 dividing the upper and lower cell divisions 16, 18. The remote edge of the upper rim second section 28 engages in the fold formed between the lower rim second and third sections 34, 36. The engagement of the upper rim edge in the fold between the lower rim second and third sections serves to positively locate the first and second sections 26, 28 of the upper rim 22 relative to the first, second and third sections 32, 34, 36 of the lower rim 24 in the positions shown in FIG. 7. In this manner, the particular configurations of the upper and lower rims 22, 24 serve to facilitate the assembly of the two cell divisions 16, 18 by the seam and according to the method of the present invention.

In forming the seam of the invention from the upper and lower rims 22, 24 of the cell divisions shown in FIG. 7, the apparatus 42 shown in cross section in FIG. 5 is employed. The apparatus 42 is basically comprised of two parts, a lower anvil member 44 and an upper hammer member 46. The hammer member 46 reciprocates toward and away from the anvil member 44 in forming the seam of the present invention between the two cell division rims 22, 24.

The anvil member 44 is formed with two recessed working surface areas 52, 54. The surface area 52 is configured to engage against the underside of the first section 32 of the lower cell division rim 24. The second surface area 54 is configured to engage against the underside of the second section 34 of the lower cell division rim 24. The first and second surface areas 52, 54 of the anvil member 44 are substantially planar surfaces. The two surface areas 52, 54 are positioned at an angle relative to each other substantially equal to the angle between the first and second rim sections 32, 34 of the lower cell division rim 24. The surface areas 52, 54 of the anvil member 44 are provided to work as anvil surfaces that support the upper and lower rims 22, 24 of the two cell divisions as the seam of the present invention is formed between the rims by the hammer member 46 of the apparatus according to the method of the invention to be explained.

An indentation 56 is formed in the anvil member working surfaces 52, 54. The indentation 56 is formed as a groove having a general V-shaped configuration with one end of the groove being positioned in the first surface area 52 of the anvil member 44 and the opposite end of the groove being positioned in the second surface area 54 of the anvil member. The indentation groove 56 extends between the first and second surface areas 52, 54 and is oriented transverse to the line of intersection between the two surface areas 52, 54.

As can be seen in FIG. 5, the anvil member working surface areas 52, 54 are recessed below mating surfaces 58, 62 of the anvil member. The recession of the anvil member working surface areas 52, 54 provides a spacing between the surface areas and the hammer member 46 working surfaces. The spacing accommodates the seam of the present invention formed in the rims 22, 24 of the cell divisions when the mating surfaces 58, 62 of the anvil member engage against complementary mating surfaces of the hammer member in forming the seam of the present invention.

The hammer member 46 is constructed comprising working surfaces complementary to the working surfaces of the anvil member 44. The hammer member is also constructed with mating surfaces 64, 66 configured to mate in complementary engagement with the respective mating surfaces 58, 62 of the anvil member 44. From the view of the seam forming apparatus 42 shown in FIG. 5, as the hammer member mating surface 64 extends upward and to the left as viewed in the drawing figure, it becomes a working surface area 64 of the hammer member that engages against the third section 36 of the lower cell division rim when forming the seam of the present invention. In the preferred embodiment of the invention, the angle formed between the two mating surfaces 64, 66 of the hammer member is about 225° with the angle between the mating surfaces 58, 62 of the anvil member being about 135°. The angle formed between the two surfaces 64, 66 of the anvil member enhances the ability of the anvil member to fold the third section 36 of the lower cell division rim 24 over the first and second sections 26, 28 of the upper cell division rim 22. The relative angle between the hammer member surface areas 64, 66 prevents the lower rim third section 36 from being folded backward, or to the right as viewed in the drawing figures, and ensures that the rim third section 36 is properly folded to the left as viewed in the drawing figures over the first and second sections of the upper rim 22. The hammer member is provided with an additional working surface area 68 that also engages against the third section 36 of the lower cell division rim when forming the seam of the present invention.

A bore hole 72 is provided in the hammer member 46 intersecting the working surfaces 64, 68 of the hammer member. A groove forming tool 74 is inserted into the bore hole 72 and is secured in an adjusted position in the bore hole by a pair of bolts 76, 78. The tool 74 has an end face with working surfaces 64', 68' formed thereon. The working surfaces 64', 68' are arranged at a relative angle to each other that is substantially equal to the relative angle between the working surfaces 64, 68 of the hammer member. When inserted into the bore hole 72 and adjusted to its working position relative to the hammer member 46 by the bolts 76, 78, the working surfaces 64', 68' of the tool 74 are positioned coplanar with the working surfaces 64, 68 of the hammer member. The end face of the tool 74 is best seen in FIG. 6.

A ridge 82 is formed on the working surfaces 64', 68' of the tool 74. The ridge 82 is employed in forming V-shaped indentation grooves in the seam of the present invention in a manner to be explained. As seen in FIGS. 5 and 6, the groove spans between the two working surfaces 64, 68 of the hammer member 46 and the working surfaces 64', 68' of the end face of the tool 74. The ridge 82 is positioned on the end face of the tool 74 opposite the indentation 56 formed in the anvil member 44. The orientation of the ridge 82 traverses the line of intersection between the first and second working surface areas 52, 54 of the anvil member 44. Although only one tool 74 is shown mounted in the hammer member 46 in the drawing figures, it should be understood that when the apparatus 42 is employed in forming the seam of the invention along a straight length of the mutually engaged rims 22, 24 of the two cell divisions 16, 18, a plurality of like tools 74 will be mounted along the length of the hammer member 46 in positions corresponding to the positions of a plurality of like indentations 56 formed along the length of the anvil member 44. For forming corners of the seam 14 such as the corner 84 of the seam shown in FIG. 1, the hammer member described mounting only one tool 74 is used. The hammer member stamps out the seam 14 a portion at a time as it is moved around the corner 84.

FIG. 9 shows the relative positions of the rims 22, 24 of the upper and lower heat exchanger cell divisions 16, 18 and the anvil member 44 and hammer member 46 of the apparatus in the initial step of forming the seam of the present invention according to the method of the present invention. As can be seen in FIG. 9, initially the upper cell division 16 is placed on the lower cell division 18 with the upper rim 22 in engagement with the lower rim 24. The engagement of the remote edge of the upper rim 22 in the fold formed between the second and third sections 34, 36 of the lower rim 24 positively positions the two rims relative to each other and holds the two rims in position during the seam forming process. The two cell divisions and their coextensive, engaging rims 22, 24 are then inserted between the anvil member 44 and the hammer member 46 of the seam forming apparatus 42. In positioning the cell divisions rims 22, 24 between the anvil member and hammer member, the undersides of the lower rim first section 32 and second section 34 are seated on the first working surface area 52 and the second working surface area 54 of the anvil member, respectively. As can be seen in FIG. 9, with the rims 22, 24 inserted between the anvil member 44 and hammer member 46, the bent edge 86 of the lower cell rim 24, along which the second section 34 of the rim joins the third section 36, abuts against a shoulder surface 88 of the anvil member 44 to properly position the upper and lower rims 22, 24 in the seam forming apparatus 42. The shoulder holds the two rims 22, 24 in their positions during the seam forming process and also maintains the third section 36 of the lower rim in its desired position relative to the surface area 64 of the hammer member.

With the upper and lower rims 22, 24 properly positioned on the anvil member 44 as shown in FIG. 9, the hammer member 46 is then lowered toward the anvil member and the working surface areas 64, 68 of the hammer member and the working surface areas 64', 68' of the groove forming tool 74 engage against the free edge of the third section 36 of the lower cell rim 24. As the hammer member 46 continues to move downward toward the anvil member 44, the engagement of the working surfaces 64, 68 of the hammer member and the working surfaces 64', 68' of the tool bend the third section 36 of the lower rim 24 over the first and second sections 26, 28 of the upper rim 22. As explained above, the relative angle between the hammer member surface areas 64, 66 ensures that the third section 36 of the lower rim is bent to the left as viewed in the drawing figures, and not to the right. As the lower rim third section 36 is bent over the first and second sections of the upper rim 22, it first overlaps the second section 28 of the upper rim on opposite sides as seen in FIG. 8. The overlapping engagement of the lower rim second and third sections 34, 36 on opposite sides of the upper rim second section 28 forms an outer portion 92 of the seam that is oriented at an angle relative to the longitudinal plane 38 dividing the upper and lower cell divisions 16, 18. The seam outer portion 92 terminates at a terminal edge 94 of the seam, the seam terminal edge 94 being formed at what was the bend 86 joining the second section 34 of the lower rim to the third section 36 of the lower rim.

As the hammer member 46 continues to move downward toward the anvil member 44, the third section 36 of the lower rim 24 is folded over the first section 26 of the upper rim 22. By folding the third section 36 of the lower rim 24 over the first section 26 of the upper rim 22, a crease 96 is formed along the middle of the seam 14. The crease 96 runs coextensive with the seam 14 formed from the upper and lower rims 22, 24. The crease 96 also divides the seam 14 into an inner portion 98 positioned adjacent the cell divisions 16, 18, and the outer portion 92 positioned on the opposite side of the crease 96 from the inner portion 98 and adjacent the terminal edge 94 of the seam.

As the lower rim third section 36 is pressed downward over the upper rim first and second sections 26, 28, the groove forming ridge 82 of the tool 74 is pressed into the crease 96 formed in the seam 14. As the ridge 82 is continued to be pressed into the crease 96, it deforms the seam in an area traversing the crease 96 by deforming the upper and lower rims 22, 24 into the indentation 56 spanning the first and second working surface areas 52, 54 of the anvil member 44. As the material of the upper and lower rims 22, 24 is deformed into the indentation 56 by the tool ridge 82, the tool ridge 82 produces a groove 102 having a general V-shaped configuration in the seam 14. The groove 102 is formed traversing the crease 96 formed in the seam 14 with opposite terminal ends of the groove 102 being positioned in the inner portion 98 of the seam and the outer portion 92 of the seam. As is best seen in FIG. 1, the groove 102 is spaced from the terminal edge 94 of the seam.

With the groove 102 formed traversing the crease 96 of the seam 14, the formation of the improved seam 14 of the present invention according to the method of the present invention is complete. A cross section of the seam 14 of the present invention is shown in FIGS. 3 and 4. In these drawing figures it can be seen that the seam 14 is formed having an inner portion 98 that extends substantially coplanar with the longitudinal plane 38 dividing the upper and lower cell divisions 16, 18. The seam also includes an outer portion 92 that is positioned at an angle relative to the inner portion 98 and the longitudinal plane 38 dividing the cell divisions. The crease 96 separates the inner and outer seam portions and runs coextensively with the seam along the upper and lower rims 22, 24 forming the seam. The crease 96 is spaced from the terminal edge 94 of the seam by the outer portion 92 of the seam. Each of the grooves 102 formed in the seam traverse the crease 96 and have opposite terminal ends positioned in the inner seam portion 98 and the outer seam portion 92. As is best seen in FIG. 1, each of the grooves 102 is spaced from the terminal edge 94 of the seam.

As explained earlier, the seam 14 may be stamped out a section at a time with the anvil member 44 and hammer member 46 progressively moving along the lengths of the first and second rims 22, 24 as portions of the seam are stamped out. In an alternate embodiment where the seam of the present invention is to be formed along a substantially straight length of the coextensive upper and lower cell division rims 22, 24, the anvil member 44 and hammer member 46 may be modified to include a plurality of indentations 56 and tools 74 spatially arranged along the lengths of the respective anvil member 44 and hammer member 46 to stamp out a longer length of the seam 14 at one time.

From viewing the seam 14 of the present invention in FIGS. 3 and 4, it should be apparent that the crease 96 formed in the seam resists relative left and right movement between the upper and lower rims 22, 24 of the cell divisions 16, 18 due to alternating heating and cooling of the cell divisions. Moreover, the groove 102 formed in the crease 96 enables the seam to resist relative movement between the upper and lower rims 22, 24 of the cell divisions into and out of the drawing figures as viewed in FIGS. 3 and 4. The combination of the crease 96 and the grooves 102 formed in the seam 14 of the present invention according to the method of the present invention produces a seam 14 with an improved capability of resisting relative movement between the rims 22, 24 of the upper and lower cell divisions due to alternating heating and cooling of the cell divisions.

While the present invention has been described by reference to a specific embodiment, it should be understood that modifications and variations of the invention may be constructed without departing from the scope of the invention defined in the following claims.

What is claimed is:

1. A heat exchanger cell for a furnace, the cell comprising:

a first cell division having a generally concave configuration;

a second cell division having a generally concave configuration;

the first cell division being positioned adjacent the second cell division and the first and second cell divisions being joined by a rigid seam, the seam extending around at least a portion of a circumference of the first and second cell divisions, the seam having a terminal edge;

a crease formed in the seam joining the first and second cell divisions, the crease being spaced form the terminal edge of the seam and dividing the seam into first and second sections the first seam section being substantially planar and the second seam section being substantially planar and positioned at an angle relative to the first seam section; and, a plurality of indentations formed in the seam, the plurality of indentations being spacially arranged along the seam and each indentation of the plurality of being spaced from the terminal edge of the seam and having a configuration of a groove traversing the crease formed in the seam, the groove having a generally V-shaped configuration with opposed planes that intersect along a line separating the opposed planes, the opposed planes ad their line of intersection extending transverse to the crease formed in the seam, and the line of intersection having opposite terminal ends with one terminal end being formed in the first section of the seam and the other terminal end being formed in the second section of the seam.

2. A heat exchange cell for a furnace, the cell comprising:

a first cell division having a generally concave configuration and a first rim extending around at least a portion of a circumference of the first cell division;

a second cell division having a generally concave configuration and a second rim extending around at least a portion of a circumference of the second cell division;

the first cell division being positioned adjacent the second cell division with the first rim being adjacent and coextensive with the second rim, the second rim being folded over and overlapping opposite side so the first rim forming a rigid seam joining the first and second rims, the seam having a terminal edge;

a crease formed in the seam joining the first and second rims, the crease being spaced from the terminal edge of the seam and dividing the seam into first and second sections the first seam section being substantially coplanar with a plane dividing the first and second cell divisions and the second seam section being oriented at an angle relative to the first seam section; and, a plurality of indentations formed in the seam joining the first and second rims, the plurality of indentations being spatially arranged along the sam and each indentation of the plurality of being spaced form the terminal edge of the seam and having a V-shaped configuration with opposed planes that intersect along a line separating the opposed planes, the opposed planes and line of intersection of each indentation extending transverse to the crease formed in the seam, and the line of intersection having opposite terminal ends with one terminal end being formed in the first section of the seam and the other terminal end being formed in the second section of the seam.

3. A method of constructing a heat exchanger cell from complementary first and second cell divisions, the first cell division having a first rim extending around at least a portion of a circumference of the first cell division and the second cell division having a second rim extending around at least a portion of a circumference of the second cell division, the method comprising:

positioning the first cell division adjacent the second cell division with the first rim being adjacent and coextensive with the second rim;

folding the second rim over the first rim overlapping opposite sides of the first rim with the second rim and thereby forming a rigid seam joining the first and second rims, the seam having a terminal edge;

forming a crease in the seam spaced from the terminal edge, the crease being coextensive with the first and second rims and dividing the seam into first and second sections with the first and second sections being positioned at an angle relative to each other; and, forming a plurality of indentations in the seam spaced for the terminal edge of the seam and spatially arranged along the seam, each indentation being formed in a configuration of a generally V-shaped groove with opposed plane intersecting along a line, the opposed planes and their line of intersection traversing the crease formed in the seam, and forming the line of intersection with opposite terminal ends in the first section of the seam end the second section of the seam.

* * * * *